US010421300B2

(12) United States Patent
Murayama et al.

(10) Patent No.: US 10,421,300 B2
(45) Date of Patent: Sep. 24, 2019

(54) LIQUID DISCHARGE APPARATUS AND ADJUSTMENT METHOD FOR RAIL UNIT

(71) Applicant: SEIKO EPSON CORPORATION, Tokyo (JP)

(72) Inventors: Osamu Murayama, Matsumoto (JP); Daisuke Hiruma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/896,562

(22) Filed: Feb. 14, 2018

(65) Prior Publication Data

US 2018/0229520 A1 Aug. 16, 2018

(30) Foreign Application Priority Data

Feb. 15, 2017 (JP) ..... 2017-026157

(51) Int. Cl.

| | |
|---|---|
| ***B41J 25/316*** | (2006.01) |
| ***B41J 2/175*** | (2006.01) |
| ***B41J 25/34*** | (2006.01) |
| ***B41J 19/00*** | (2006.01) |

(52) U.S. Cl.

CPC ..... *B41J 25/316* (2013.01); *B41J 2/1752* (2013.01); *B41J 19/00* (2013.01); *B41J 25/34* (2013.01)

(58) Field of Classification Search

CPC ..... B41J 25/316; B41J 19/00; B41J 2/1752; B41J 25/34

See application file for complete search history.

(56) References Cited

U.S. PATENT DOCUMENTS

2011/0181659 A1 7/2011 Fukunaga
2013/0271527 A1* 10/2013 Shimizu ..... B41J 23/00 347/37
2017/0106686 A1 4/2017 Hiruma et al.

FOREIGN PATENT DOCUMENTS

| | | | |
|---|---|---|---|
| EP | 2789464 | A | 10/2014 |
| JP | 2011-173416 | A | 9/2011 |
| JP | 2013-119216 | A | 6/2013 |
| JP | 2013-233792 | A | 11/2013 |
| JP | 2017-077663 | A | 4/2017 |

OTHER PUBLICATIONS

IP.com (Year: 2018).*

* cited by examiner

*Primary Examiner* — Lisa Solomon
(74) *Attorney, Agent, or Firm* — Workman Nydegger

(57) ABSTRACT

A liquid discharge apparatus that includes a first movable unit displaceably attached to a fixture portion, a rail unit that includes a planar portion formed along a first direction and is displaceable according to displacement of the first movable unit, and a carriage attached to the rail unit so as to be movable in the first direction and whose posture is changeable according to angle of the planar portion with respect to the fixture portion viewed in the first direction. The first movable unit includes a first adjuster that adjusts position of the rail unit with respect to the fixture portion in a second direction and a second adjuster that adjusts the angle of the planar portion with respect to the fixture portion as viewed in the first direction by pivoting the rail unit around a pivot axis that extends in the first direction.

7 Claims, 10 Drawing Sheets

LIQUID DISCHARGE APPARATUS AND ADJUSTMENT METHOD FOR RAIL UNIT

BACKGROUND

1. Technical Field

The present invention relates to a liquid discharge apparatus and an adjustment method for a rail unit.

2. Related Art

Various liquid discharge apparatuses have been in use. One of these is a liquid discharge apparatus that forms images by moving a carriage that includes a head capable of discharging liquid, back and forth along a rail unit.

For example, JP-A-2013-233792 discloses an image forming apparatus (liquid discharge apparatus) that forms images by moving a carriage that includes a head capable of discharging liquid, back and forth along a guide member (rail unit).

In a related-art liquid discharge apparatus that forms images by moving a carriage that includes a head capable of discharging liquid back and forth along a rail unit, it sometimes happens that the rail unit shifts from a desired posture and therefore changes the posture of the carriage so that accuracy in forming an image decreases. In the image formation apparatus disclosed in JP-A-2013-233792, a stay member that holds the guide member is adjustable in posture by rotating two adjustment pin members, so that the stay member can be adjusted in the rotation directions. However, the shifting of the rail unit from the desired posture is not limited to that in the rotation directions. Therefore, users demand that the posture of the rail unit be adjustable in various directions.

SUMMARY

An advantage of some aspects of the invention is that the posture of a rail unit becomes adjustable in various directions.

One aspect of the invention provides a liquid discharge apparatus that includes a fixture portion, a first movable unit displaceably attached to the fixture portion, a rail unit that extends in a first direction, includes a planar portion formed along the first direction, and is displaceable according to displacement of the first movable unit, and a carriage which includes a head capable of discharging a liquid, the carriage is attached to the rail unit so as to be movable in the first direction and whose posture as viewed in the first direction is changeable according to angle of the planar portion with respect to the fixture portion viewed in the first direction. The first movable unit includes a first adjuster that adjusts position of the rail unit with respect to the fixture portion in a second direction which intersects the first direction and in which the rail unit and the fixture portion face each other and a second adjuster that adjusts the angle of the planar portion with respect to the fixture portion as viewed in the first direction by pivoting the rail unit around a pivot axis that extends in the first direction.

According to this aspect of the invention, the position of the rail unit relative to the fixture portion in the second direction can be adjusted by the first adjuster, and the angle of the planar portion with respect to the fixture portion as viewed in the first direction can be adjusted by pivoting the rail unit around the pivot axis extending in the first direction through the use of the second adjuster. That is, the posture of the rail unit can be adjusted in not only the rotation direction but also the second direction. Thus, the posture of the rail unit can be adjusted in various directions.

In the foregoing liquid discharge apparatus, a distance between the first adjuster and the rail unit in a third direction that intersects the first direction and the second direction may be shorter than a distance between the second adjuster and the rail unit in the third direction.

According to this embodiment, the distance between the first adjuster and the rail unit in the third direction is shorter than the distance between the second adjuster and the rail unit in the third direction. That is, the distance between the first adjuster and the rail unit in the third direction is relatively short. By shortening the distance between the first adjuster and the rail unit in the third direction, the position of the rail unit can be inhibited from changing in the second direction due to adjustment by the second adjuster or the like after the position of the rail unit in the second direction has been adjusted by the first adjuster.

In the foregoing embodiment of the liquid discharge apparatus of the invention, a position of the first adjuster in the third direction may be the same as a position of the rail unit in the third direction.

According to this embodiment of the foregoing aspect of the invention, since the position of the first adjuster in the third direction is the same as the position of the 1 rail unit in the third direction, the position of the rail unit can be particularly effectively inhibited from changing in the second direction due to adjustment by the second adjuster or the like after the position of the rail unit in the second direction has been adjusted by the first adjuster.

Note that the expression of "the position of the first adjuster in the third direction is the same as the position of the rail unit in the third direction" means that the position of a center of the first adjuster in the third direction is substantially the same as the position of a center of the rail unit in the third direction and means that a certain amount of positional deviation of the two centers is permissible.

In the foregoing liquid discharge apparatus, a position of the pivot axis in a third direction that intersects the first direction and the second direction may be the same as a position of the rail unit in the third direction.

According to this embodiment, since the position of the pivot axis in the third direction is the same as the position of the rail unit in the third direction, the position of the rail unit can be effectively inhibited from changing in the second direction as the angle of the planar portion with respect to the fixture portion as viewed in the first direction is adjusted by the second adjuster.

Note that the foregoing expression of "the position of the pivot axis in the third direction is the same as the position of the rail unit in the third direction" means that the position of a portion that serves as the pivot axis in the third direction is substantially the same as the position of a center of the rail unit in the third direction and means that a certain amount of deviation of the position of the portion that serves as the pivot axis and the position of the center of the rail unit is permissible.

The foregoing liquid discharge apparatus may further include a second movable unit to which the rail unit is attached so that the planar portion serves as an attaching surface and which is attached to the first movable unit together with the rail unit attached. The second movable unit may include a third adjuster that adjusts position of the rail unit with respect to the first movable unit in a third direction that intersects the first direction and the second direction.

According to this embodiment of the foregoing aspect, since the liquid discharging apparatus includes the third adjuster that adjusts the position of the rail unit relative to the first movable unit (i.e., to the fixture portion) in the third direction, the posture of the rail unit can be adjusted not only in the rotation direction and the second direction but also in the third direction, that is, the posture of the rail unit can be adjusted in more various directions.

In the liquid discharge apparatus according to this embodiment, the fixture portion may have three or more faces, and the first adjuster, the second adjuster, and the third adjuster may be disposed in respectively different faces of the three of more faces of the fixture portion.

According to this embodiment, since the first adjuster, the second adjuster, and the third adjuster are disposed in respectively different faces of the fixture portion, operation regions can be dispersed, so that the adjustment operation can be more easily performed.

Note that the meaning of "the first adjuster, the second adjuster, and the third adjuster are disposed in respectively different faces of the fixture portion" includes a configuration in which the first adjuster, the second adjuster, and the third adjuster are disposed directly in respectively different faces of the fixture portion and also a configuration in which at least one of the first adjuster, the second adjuster, and the third adjuster is disposed indirectly in one of different faces of the fixture portion via another member.

In the liquid discharge apparatus according to this embodiment of the invention, the fixture portion may have a first face that faces one of two sides in the third direction, a second face that faces another one of the two sides in the third direction, and a third face that faces one of two sides in the second direction. The first adjuster may be disposed in the first face, the second adjuster may be disposed in the second face, and the third adjuster may be disposed in the third face.

According to this embodiment, since the first adjuster, the second adjuster, and the third adjuster are disposed in the first face, the second face, and the third face, respectively, the adjusters can be suitably dispersed to different faces of the fixture portion.

Another aspect of the invention provides a rail unit adjustment method for a liquid discharge apparatus that includes a fixture portion, a first movable unit displaceably attached to the fixture portion, a rail unit that extends in a first direction, includes a planar portion formed along the first direction, and is displaceable according to displacement of the first movable unit, and a carriage which includes a head capable of discharging a liquid, the carriage is attached to the rail unit so as to be movable in the first direction and whose posture as viewed in the first direction is changeable according to angle of the planar portion with respect to the fixture portion viewed in the first direction. The rail unit adjustment method includes adjusting position of the rail unit with respect to the fixture portion in a second direction which intersects the first direction and in which the rail unit and the fixture portion face each other by using the first movable unit, and adjusting angle of the planar portion with respect to the fixture portion as viewed in the first direction by pivoting the rail unit around a pivot axis extending in the first direction through use of the first movable unit.

According to this aspect of the invention, the position of the rail unit relative to the fixture portion in the second direction can be adjusted by the first movable unit, and the angle of the planar portion with respect to the fixture portion as viewed in the first direction can be adjusted by pivoting the rail unit around the pivot axis extending in the first direction. That is, the posture of the rail unit can be adjusted in not only the rotation direction but also the second direction. Thus, the posture of the rail unit can be adjusted in various directions.

BRIEF DESCRIPTION OF THE DRAWINGS

The invention will be described with reference to the accompanying drawings, wherein like numbers reference like elements.

DESCRIPTION OF EXEMPLARY EMBODIMENTS

A printing apparatus as a liquid discharge apparatus according to an exemplary embodiment of the invention will be described in detail hereinafter with reference to the accompanying drawings.

First, a printing apparatus according to an exemplary embodiment of the invention will be outlined.

Figure 1:
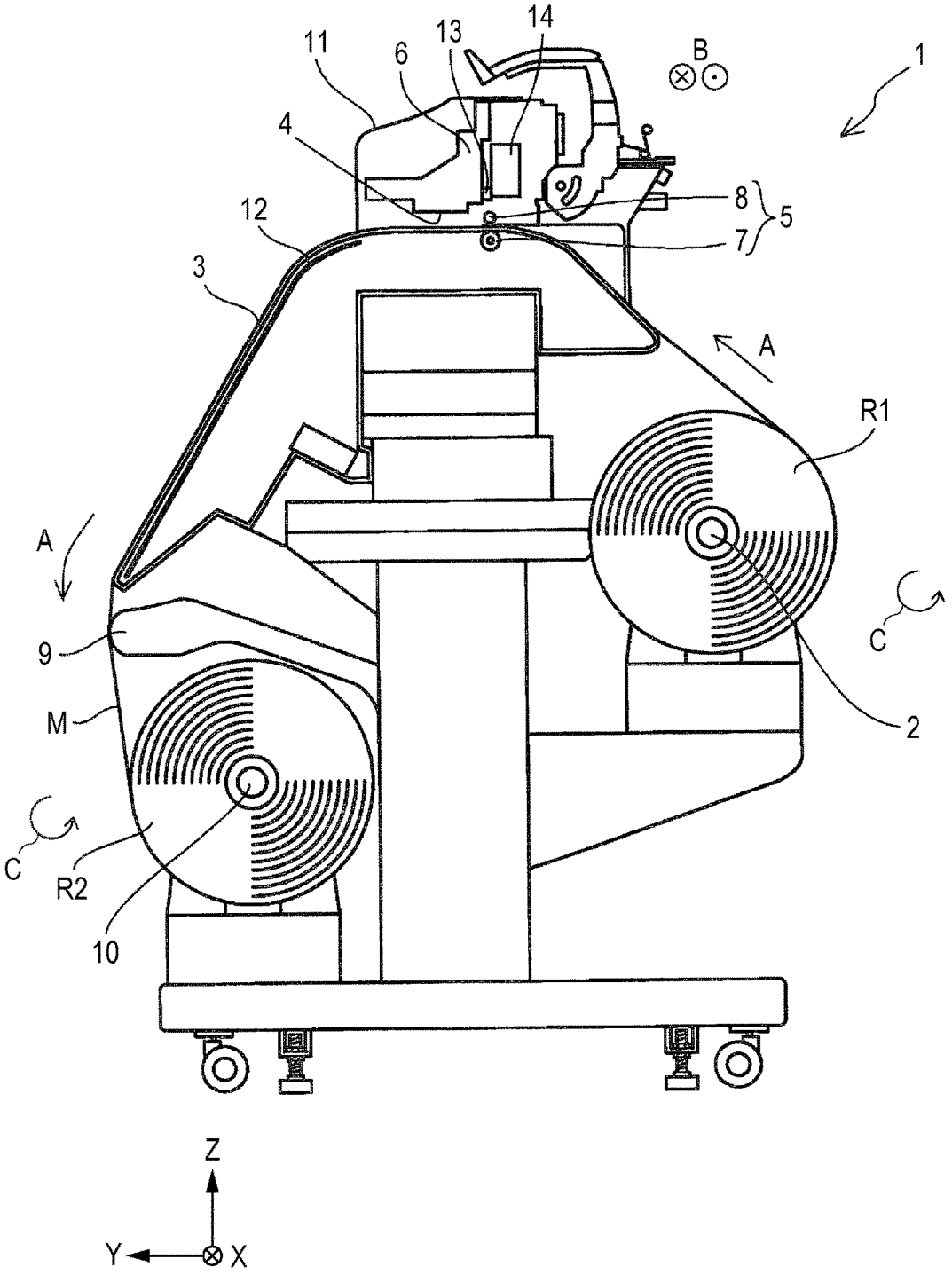
FIG. 1 is a schematic side view of a printing apparatus according to an exemplary embodiment of the invention.

FIG. 1 is a schematic side view of a printing apparatus 1 according to this exemplary embodiment.

The printing apparatus 1 in this exemplary embodiment includes a support shaft 2 that supports a roll R1 of a medium M that is unrolled and subjected to printing. When the printing apparatus 1 of the exemplary embodiment transports the medium M in a transport direction A, the support shaft 2 rotates in a rotation direction C. Although in this exemplary embodiment, the printing apparatus 1 uses a roll of medium M whose printing surface faces outward in the rolled state. However, when a roll of medium M whose printing surface faces inward in the rolled state is used, the printing apparatus 1 is able to rotate the support shaft 2 in the direction opposite to the rotation direction C in order to unroll the roll R1 and feed out the medium M.

Furthermore, although the printing apparatus 1 of the exemplary embodiment uses the roll type medium as a medium M, the invention is not limited to such printing apparatuses that use roll type media. For example, a cut-sheet type medium may be used.

Furthermore, the printing apparatus 1 of this exemplary embodiment includes a transport roller pair 5 made up of a driving roller 7 and a driven roller 8 that are configured to transport the medium M in the transport direction A along a transport path of the medium M that is formed by, for example, a support unit 3 that supports the medium M.

Note that in the printing apparatus 1 of this exemplary embodiment, the driving roller 7 is provided as a single roller that extends in scanning directions B that intersect the transport direction A of the medium M while the driven roller 8 includes a plurality of rollers (i.e., there are provided a plurality of driven rollers 8) disposed side by side in the scanning directions B at a position that faces the driving roller 7.

A lower portion of the support unit 3 is provided with a heater 12 as a heating unit that is capable of heating the medium M supported by the support unit 3. Although in this exemplary embodiment, the printing apparatus 1 includes as a heating unit the heater 12 capable of heating the medium M from a support unit 3 side, the printing apparatus 1 may instead include an infrared heater or the like that is provided at a position that faces the support unit 3.

The printing apparatus 1 of this exemplary embodiment further includes inside a casing 11 a head 4 that includes a plurality of nozzles formed in a nozzle formation surface and that ejects an ink as a liquid from the nozzles and a carriage 6 capable of moving back and forth in the scanning directions B with the head 4 attached thereto.

In the printing apparatus 1 of this exemplary embodiment, the transport direction A of the medium M at a position on the support unit 3 which faces the head 4 (the nozzle formation surface) is along a direction Y that is a horizontal direction, the scanning directions B of the head 4 are horizontal directions that are along a direction X perpendicular to the direction Y, and an ink discharging direction is along a direction Z that is a vertical direction (i.e., the ink discharging direction is a vertically downward direction). Furthermore, a first direction mentioned later is along the direction X, a second direction mentioned later is along the direction Y, and a third direction mentioned later is along the direction Z.

A frame 14 provided as a fixture portion is provided inside the casing 11. A guide rail 13 provided as a rail unit that extends in the direction X is attached to the frame 14 via a first movable unit 15 (see FIG. 5 and the like) and a second movable unit 16 (see FIG. 5 and the like) that are described later. The carriage 6 provided with the head 4 is attached to the guide rail 13. Since the carriage 6 is attached to the guide rail 13, the carriage 6 is indirectly attached to the frame 14. An attaching unit 28 (see FIGS. 2 to 6) for the carriage 6 which includes the guide rail 13, the frame 14, etc. and which may be considered a feature of the printing apparatus 1 of this exemplary embodiment will be described in detail later.

Due to the foregoing configuration, the head 4 is capable of performing printing by discharging ink from the nozzles (not depicted) to the medium M on the transport path while being moved back and forth along the scanning directions B that intersect the transport direction A of the medium M. Since the head 4 configured as described above is provided, the printing apparatus 1 of this exemplary embodiment is capable of forming a desired image on the medium M by repeatedly performing an operation of causing the medium M to be transported a predetermined amount (corresponding to one pass) in the transport direction A and an operation of causing, while holding the medium M still, the head 4 to discharge ink while being moved along the scanning directions B.

A winding shaft 10 capable of winding the medium M into a roll R2 is provided downstream of the head 4 in the transport direction A of the medium M. In this exemplary embodiment, since the medium M is wound up so that the printed surface faces outward, the winding shaft 10 rotates in a rotation direction C to wind up the medium M. On the other hand, in the case where the medium M is wound up so that the printed surface faces inward, the winding shaft 10 can be rotated in the direction opposite to the rotation direction C to wind up the medium M.

A tension bar 9 capable of giving a desired tension to the medium M is provided between a downstream end portion of the support unit 3 in the transport direction A of the medium M and the winding shaft 10. A contact portion of the tension bar 9 with the medium M extends along the scanning directions B.

Next, the attaching unit 28 for the carriage 6, which constitutes portions that may be considered a feature of the printing apparatus 1 of this exemplary embodiment, will be described.

Figure 2:
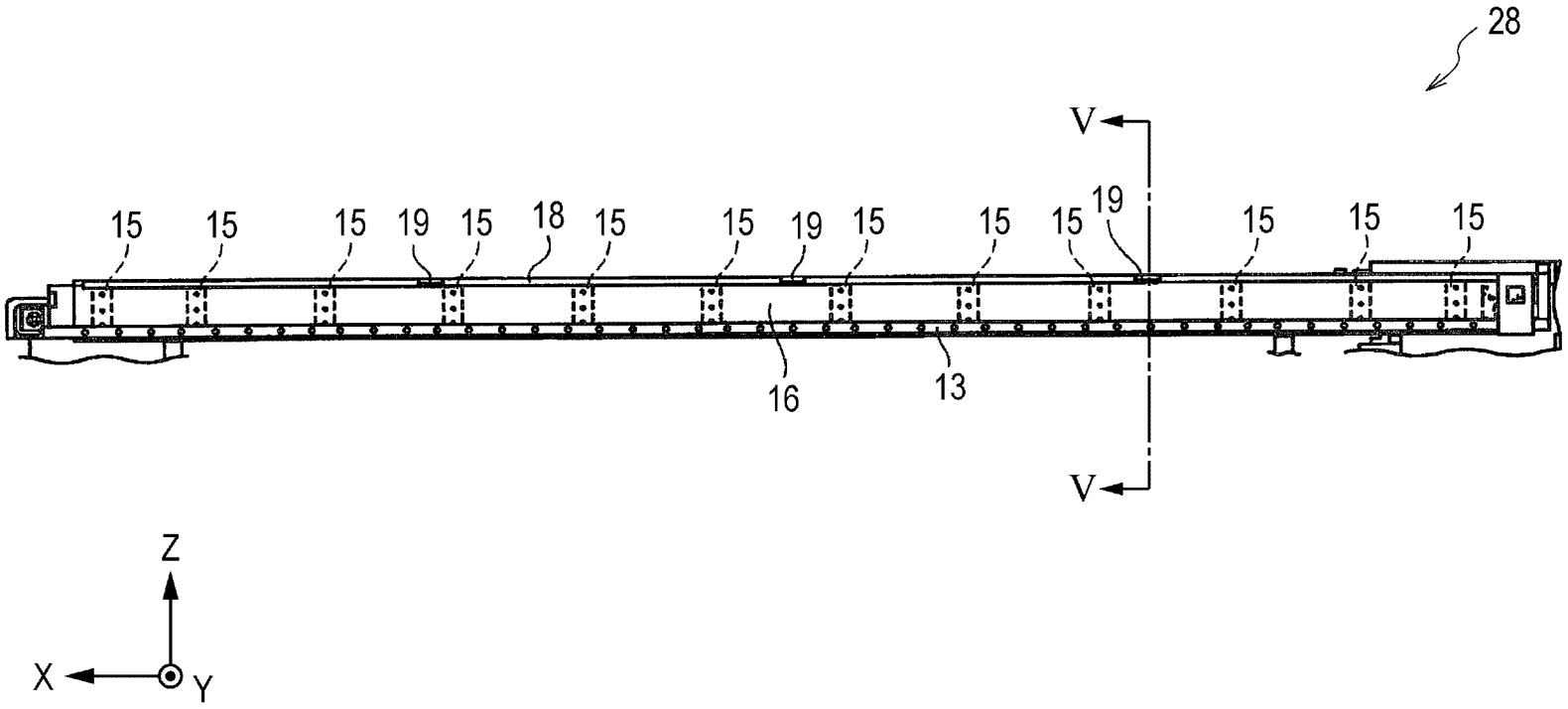
FIG. 2 is a front view of portions of the printing apparatus according to the exemplary embodiment of the invention.
Figure 3:
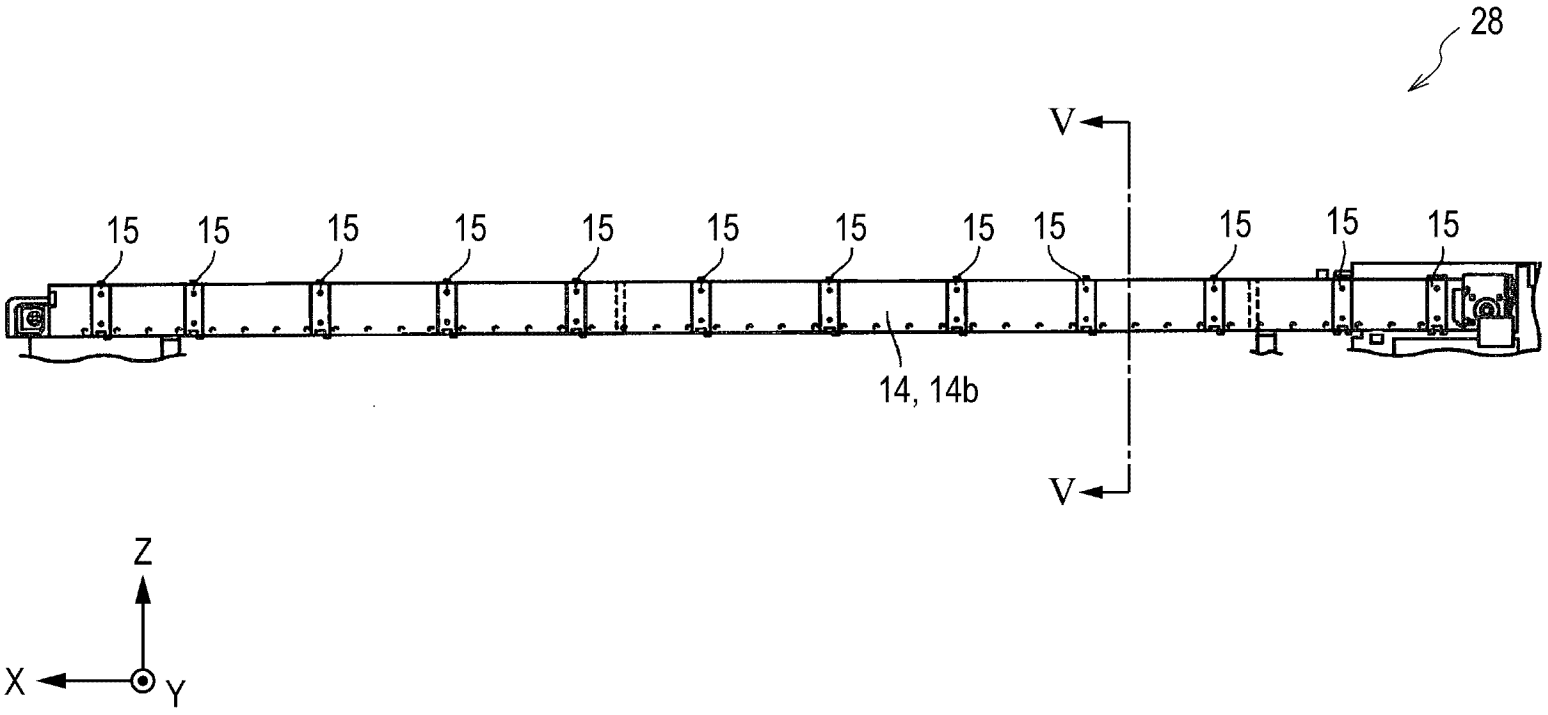
FIG. 3 is a front view of portions of the printing apparatus according to the exemplary embodiment of the invention.
Figure 4:
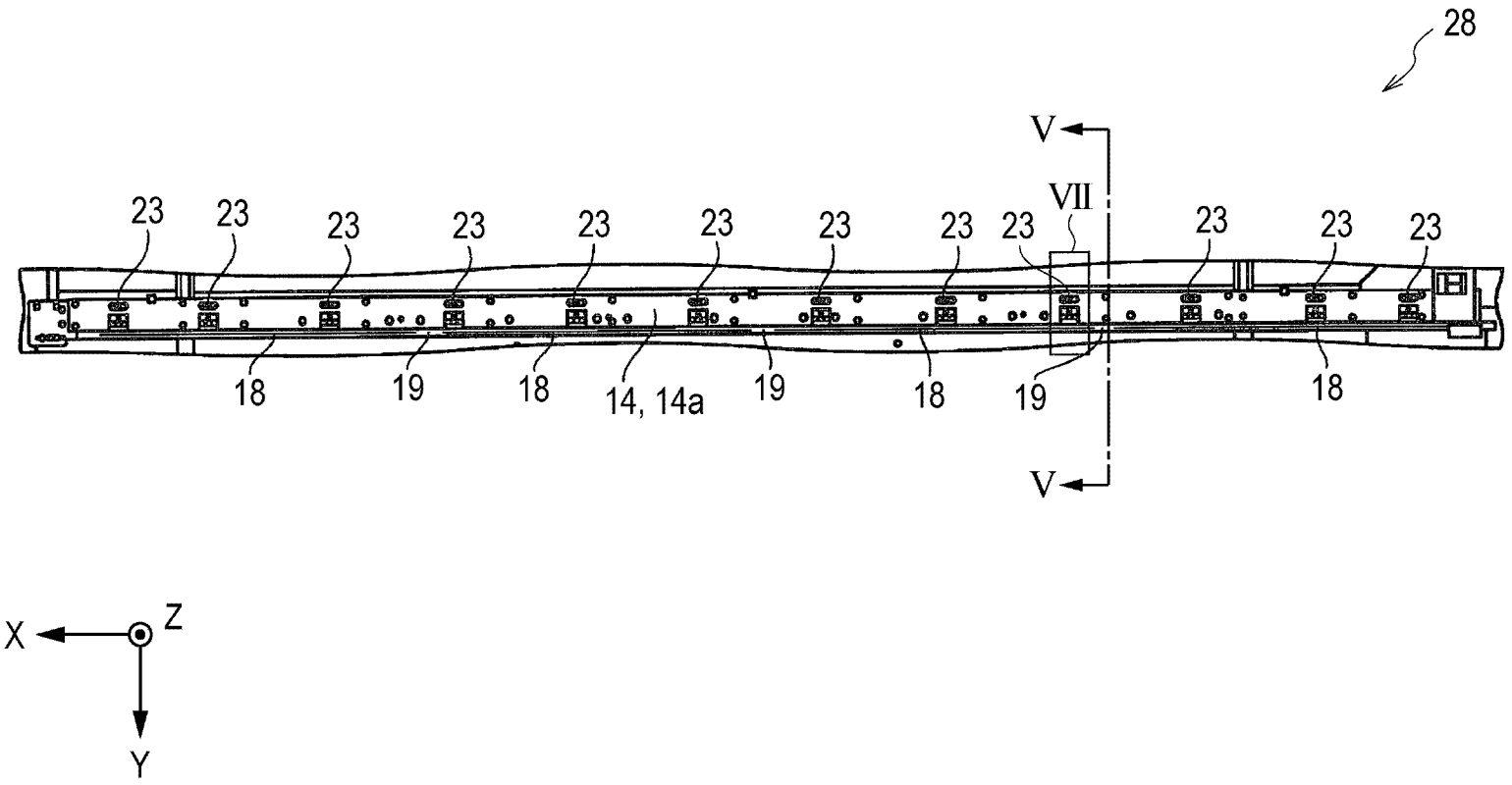
FIG. 4 is a plan view of portions of the printing apparatus according to the exemplary embodiment of the invention.
Figure 5:
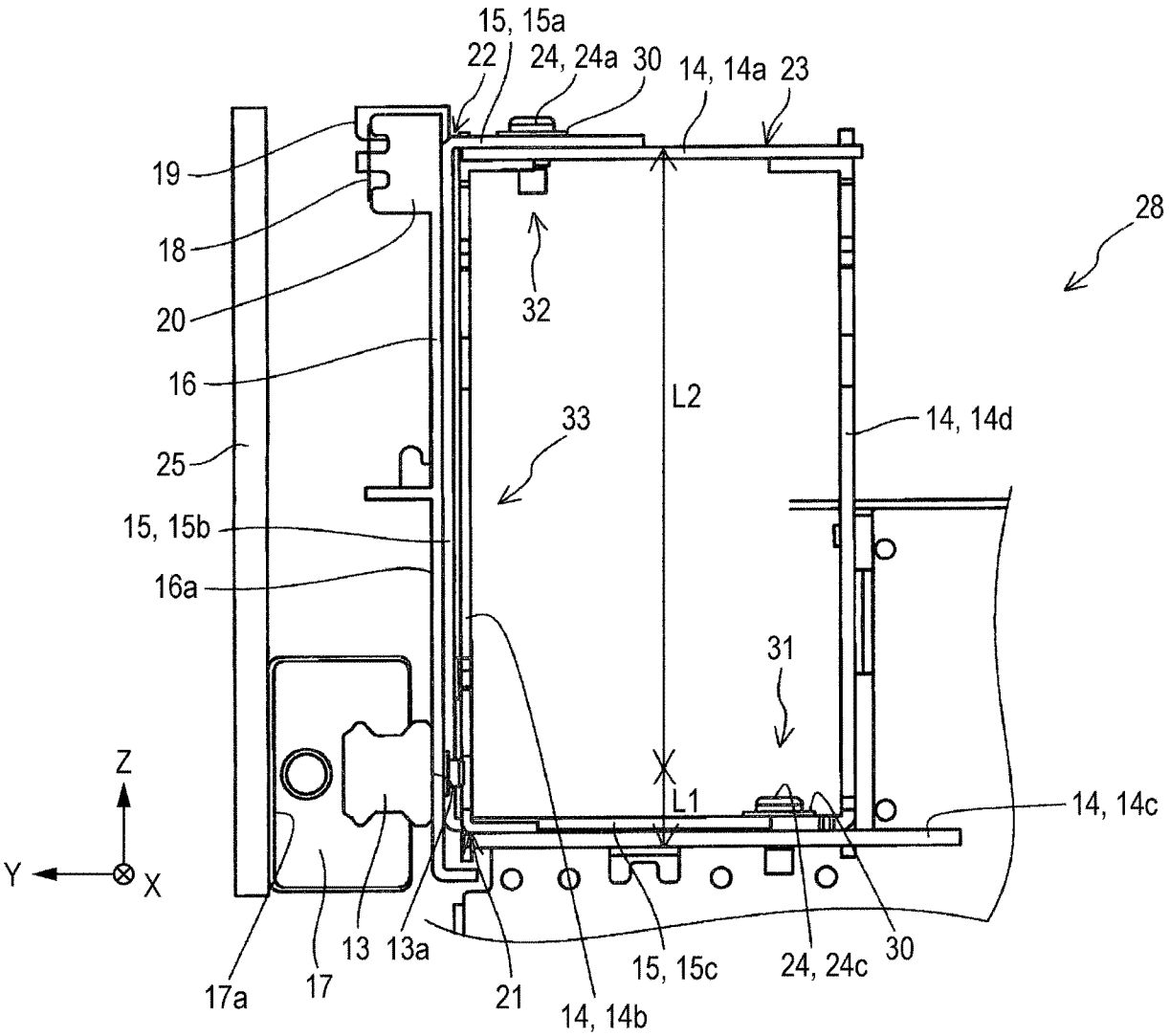
FIG. 5 is a side sectional view of portions of the printing apparatus according to the exemplary embodiment of the invention.
Figure 6:
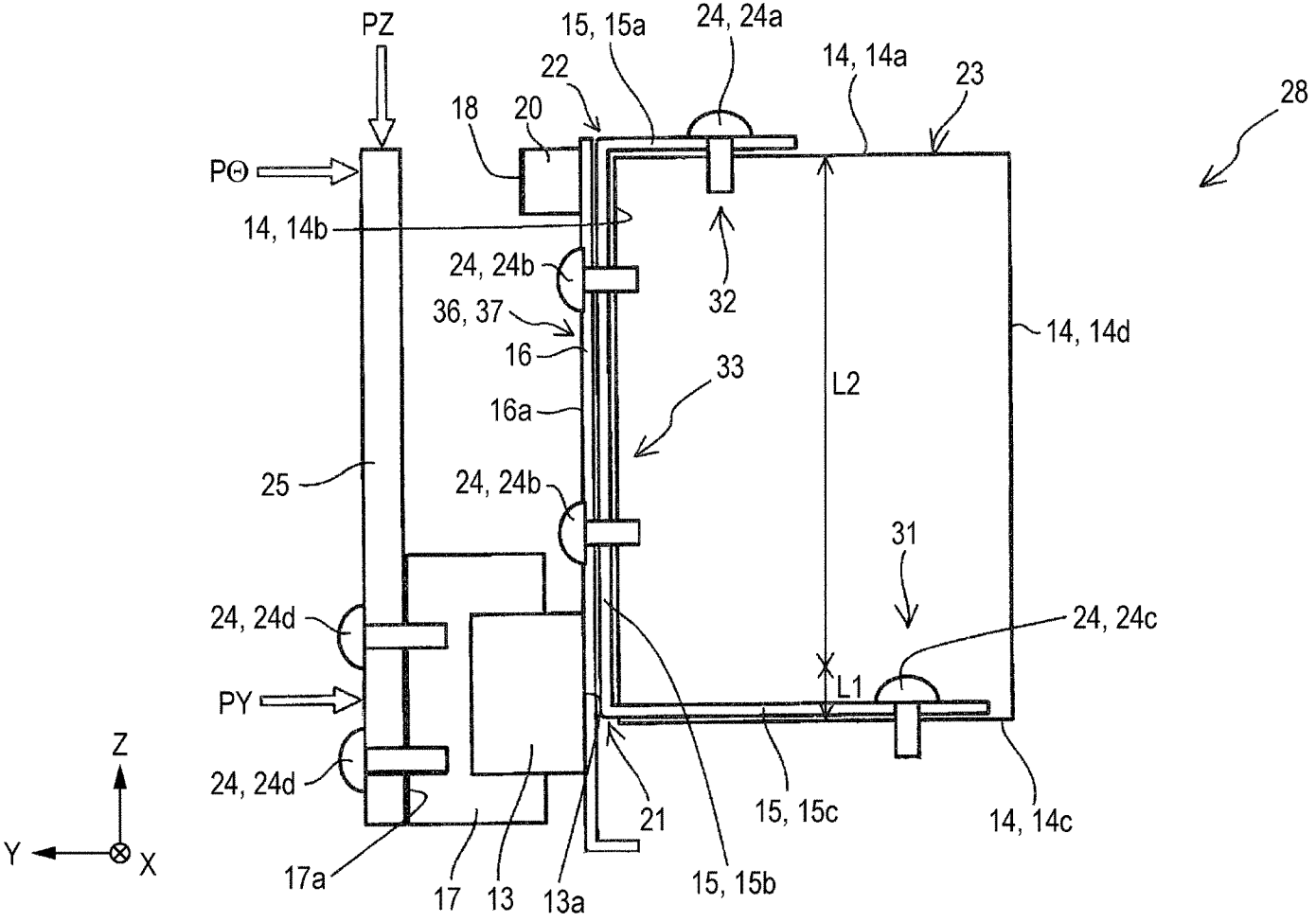
FIG. 6 is a schematic side sectional view of portions of the printing apparatus according to the exemplary embodiment of the invention.
Figure 7:
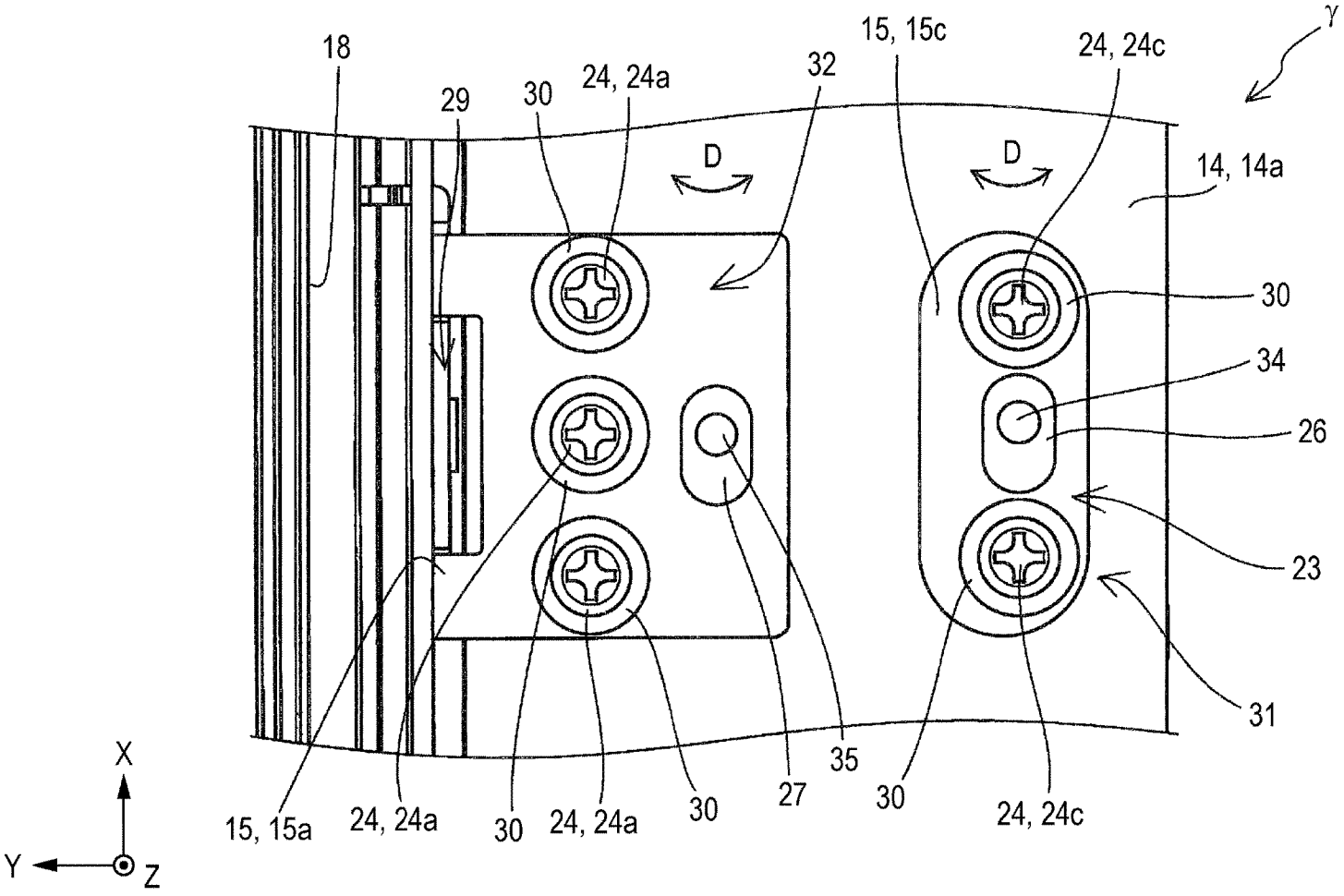
FIG. 7 is a plan view of portions of the printing apparatus according to the exemplary embodiment of the invention.
Figure 8:
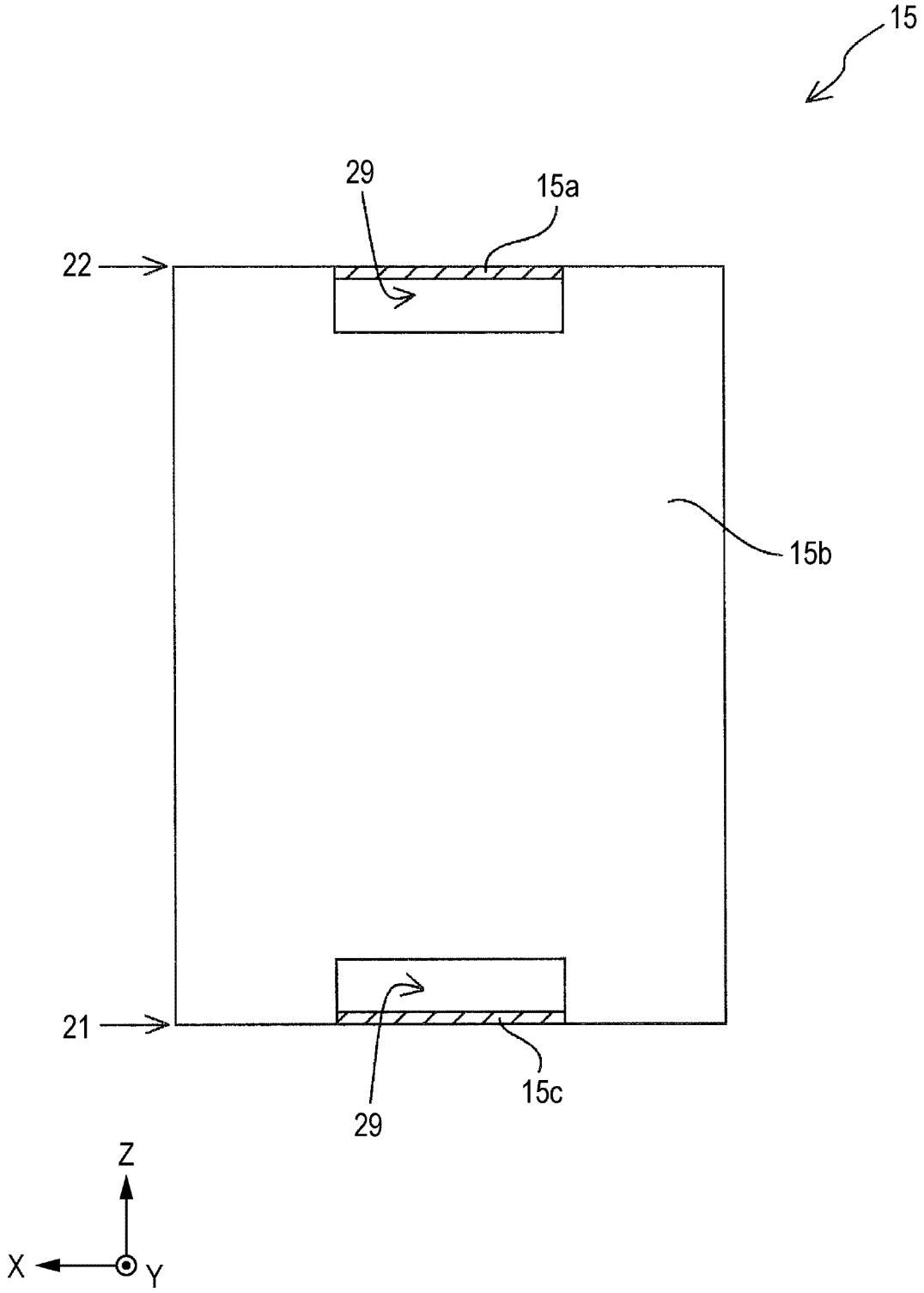
FIG. 8 is a schematic front view of portions of the printing apparatus according to the exemplary embodiment of the invention.
Figure 9:
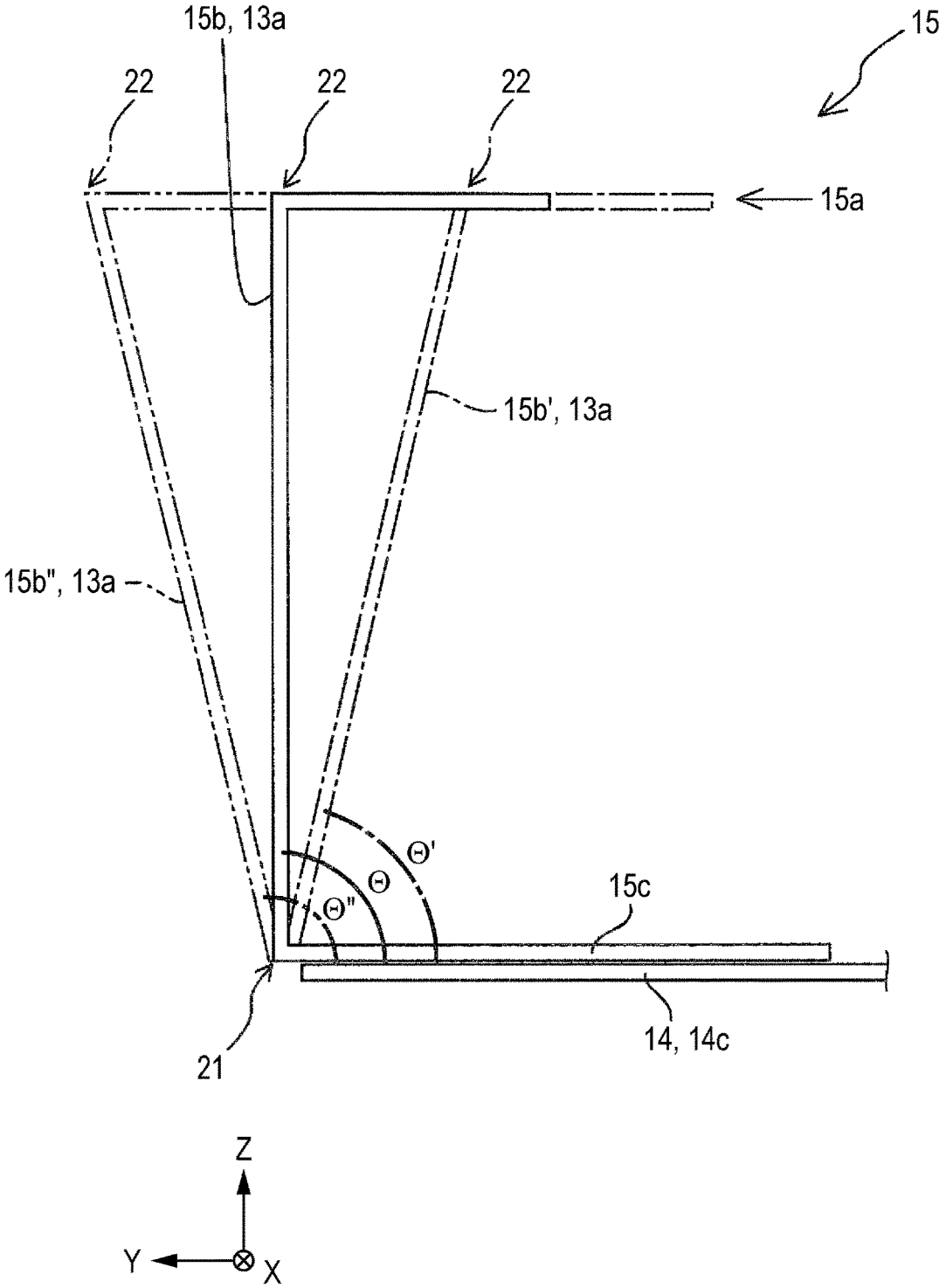
FIG. 9 is a schematic side view of portions of the printing apparatus according to the exemplary embodiment of the invention.

FIGS. 2 and 3 are front views of the attaching unit 28 for the carriage 6 in the printing apparatus 1 of this exemplary embodiment. FIG. 2 illustrates a state in which the carriage 6 has been removed together with a block 17 (described later). FIG. 3 illustrates a state in which a second movable unit 16 with the guide rail 13 and the like attached thereto has been removed. FIG. 4 is a plan view of the attaching unit 28 for the carriage 6 in the printing apparatus 1 of this exemplary embodiment. FIG. 5 is a side sectional view of the attaching unit 28 for the carriage 6 in the printing apparatus 1 of this exemplary embodiment taken on line V-V of FIGS. 2 to 4 and viewed in a direction of arrows V and V. FIG. 6 is a schematic side sectional diagram of what is illustrated in FIG. 5. FIG. 7 is a plan view of a region VII indicated in FIG. 4 which includes a portion of the attaching unit 28 for the carriage 6 in the printing apparatus 1 of this exemplary embodiment. FIG. 8 is a schematic front view of a first movable unit 15 that is a portion that may be considered a feature of the printing apparatus 1 of this exemplary embodiment. FIG. 9 is a schematic side view of the first movable unit 15 in the printing apparatus 1 of this exemplary embodiment.

FIGS. 2 to 9 do not all necessarily illustrate all members and the like but some of the figures may omit illustrations of one or more members or the like. In FIGS. 5 and 6, in place of the carriage 6, a jig 25 used at the time of adjusting the posture of the guide rail 13 has been attached to the block 17. That is, when the jig 25 is replaced with the carriage 6 in FIGS. 5 and 6, a state that allows printing is established.

As illustrated in FIGS. 5 and 6, the attaching unit 28 for the carriage 6 in the printing apparatus 1 of this exemplary embodiment includes the frame 14, the first movable unit 15 displaceably attached to the frame 14, the second movable unit 16 displaceably attached to the first movable unit 15, the guide rail 13 provided on the second movable unit 16, and the block 17 to which the carriage 6 can be attached and which has such a shape corresponding to the guide rail 13 as to fit to the guide rail 13.

The frame 14, as illustrated in FIG. 5, includes a frame 14*a* formed at one of two sides (an upper side) in the direction Z as the third direction, a frame 14*b* formed at one of two sides in the direction Y as the second direction, a frame 14*c* formed in the other side (a lower side) in the direction Z as the third direction, and a frame 14*d* formed on the other side in the direction Y as the second direction.

The first movable unit 15, as illustrated in FIGS. 5 and 6, includes an upper surface portion 15*a* that faces the frame 14*a*, a side surface portion 15*b* that faces the frame 14*b*, and a lower surface portion 15*c* that faces the frame 14*c*. Note that the upper surface portion 15*a* is fixable to the frame 14*a* by screws 24 (screws 24*a*) and the lower surface portion 15*c* is fixable to the frame 14*c* by screws 24 (screws 24*c*).

As illustrated in FIG. 4, FIG. 7, etc., the frame 14*a* is provided with adjustment holes 23 that allow adjustment of a first adjuster 31 provided on the lower surface portion 15*c*. As illustrated in FIGS. 5 and 7, the first adjuster 31 is configured so that each screw 24*c* can be fixed to the frame 14*c* via a washer 30 and the lower surface portion 15*c*. That is, the frame 14*c* is provided with female threads that correspond to threaded shafts of the screws 24*c*. Then, the lower surface portion 15*c* has at each of positions that correspond to lower portions of the washers 30 such a hole portion (i.e., a lower surface-side hole portion, not depicted) that a gap is formed between a hole edge of the hole portion and the threaded shaft of a screw 24*c* inserted in the hole portion (i.e., a hole portion whose opening area is larger than the cross-sectional area of the threaded shaft). The lower surface-side hole portions, concretely, are elongated holes whose longitudinal direction coincides with the direction Y. In the state illustrated in FIGS. 5 and 7, the threaded shaft of each screw 24*c* is inserted in one of the lower surface-side hole portions. As illustrated in FIG. 7, the lower surface portion 15*c* has cam receptacles 26 near the screws 24*c*. The cam receptacles 26 are through hole having an elongated hole shape. Portions of the frame 14*c* that face interiors of the cam receptacles 26 are provided with insert holes 34. Due to this configuration, each cam receptacle 26 is able to receive therein an eccentric screwdriver whose distal end portion is provided with an eccentric cam. Concretely, a protrusion formed on the distal end of the eccentric cam is inserted into an insert hole 34 so that the eccentric cam contacts the cam receptacle 26. Then, the eccentric screwdriver is turned in one of rotation directions D, with the protrusion of the eccentric cam being the center of rotation, so that the lower surface portion 15*c* of the first movable unit 15, utilizing the lower surface-side hole portions, moves along the direction Y.

Because of this configuration, after the screws 24*c* are loosened by using, for example, a screwdriver inserted through an adjustment hole 23, the lower surface portion 15*c* of the first movable unit 15 can be moved along the direction Y relative to the frame 14*c* by inserting an eccentric screwdriver into a cam receptacle 26 and turning the eccentric screwdriver in one of the rotation directions D. After the lower surface portion 15*c* is moved to an appropriate position relative to the frame 14*c*, the screws 24*c* are tightened. Thus, the lower surface portion 15*c* can be appropriately positioned relative to the frame 14*c*. In the attaching unit 28 in this exemplary embodiment, the frame 14*a* is provided with the adjustment holes 23 that allow the lower surface portion 15*c* to be fixed to the frame 14*c* by using a screwdriver from above. However, this configuration does not limit the invention. For example, a configuration in which the lower surface portion 15*c* is fixed to the frame 14*c* from below may also be adopted. Furthermore, instead of the configuration that allows an eccentric cam to be inserted from outside, a configuration in which each cam receptacle 26 is provided with an eccentric cam may be adopted.

As illustrated in FIGS. 5 and 7, there is provided a second adjuster 32 in which the screws 24*a* can be fixed to the frame 14*a* via washers 30 and the upper surface portion 15*a* of the first movable unit 15. Concretely, the frame 14*a* is provided with female threads that correspond to threaded shafts of the screws 24*a*. The upper surface portion 15*a* has at each of positions that correspond to lower portions of the washers 30 such a hole portion (i.e., an upper surface-side hole portion, not depicted) that a gap is formed between a hole edge of the hole portion and the threaded shaft of a screw 24*a* inserted in the hole portion. The upper surface-side hole portions, concretely, are elongated holes whose longitudinal direction coincides with the direction Y. In the state illustrated in FIGS. 5 and 7, the threaded shaft of each screw 24*a* is inserted in one of the upper surface-side hole portions. As illustrated in FIG. 7, the upper surface portion 15*a* has cam receptacles 27 near the screws 24*a*. The cam receptacles 27 are through hole having an elongated hole shape. Portions of the frame 14*a* that face interiors of the cam receptacles 27 are provided with insert holes 35. Due to this configuration, each cam receptacle 27 is able to receive therein an eccentric screwdriver whose distal end portion is provided with an eccentric cam. Concretely, a protrusion formed on the distal end of the eccentric cam is inserted into an insert hole 35 so that the eccentric cam contacts the cam receptacle 27. Then, the eccentric screwdriver is turned in one of rotation directions D, with the protrusion of the eccentric cam being the center of rotation, so that the upper surface portion 15*a* of the first movable unit 15, utilizing the upper surface-side hole portions, moves along the direction Y.

Because of this configuration, after the screws 24*a* are loosened by using, for example, a screwdriver, the upper surface portion 15*a* of the first movable unit 15 can be moved along the direction Y relative to the frame 14*a* by inserting an eccentric screwdriver into a cam receptacle 27 and turning the eccentric screwdriver in one of the rotation directions D. After the upper surface portion 15*a* is moved to an appropriate position relative to the frame 14*a*, the screws 24*a* are tightened. Thus, the upper surface portion 15*a* can be appropriately positioned relative to the frame 14*a*. Note that, instead of the configuration that allows an eccentric cam to be inserted from outside, a configuration in which each cam receptacle 27 is provided with an eccentric cam may be adopted.

The second movable unit 16, as illustrated in FIG. 6, is configured so as to be fixable to the side surface portion 15*b* by screws 24*b* in a third adjuster 33. Concretely, the side surface portion 15*b* is provided with female threads that correspond to threaded shafts of the screws 24*b*. The second movable unit 16 is provided with hole portions (side surface-side hole portions, not depicted) each of which corresponds to the threaded shaft of a screw 24*b* and forms a gap between a hole edge thereof and the threaded shaft. The side surface-side hole portions, concretely, are elongated holes whose longitudinal direction coincides with the direction Z. In the state illustrated in FIG. 6, the threaded shaft of each screw 24*b* is inserted in one of the side surface-side hole portions. The second movable unit 16 has cam receptacles 36 near the screws 24*b*. The cam receptacles 36 are through hole having an elongated hole shape. Portions of the side surface portion 15*b* that face interiors of the cam receptacles 36 are provided with insert holes 37. Due to this configuration, each cam receptacle 36 is able to receive therein an eccentric screwdriver whose distal end portion is provided with an eccentric cam. Concretely, a protrusion formed on the distal end of the eccentric cam is inserted into an insert hole 37 so that the eccentric cam contacts the cam receptacle 36. Then, the eccentric screwdriver is turned, with the protrusion of the eccentric cam being the center of rotation, so that the second movable unit 16, utilizing the side surface-side hole portions, moves along the direction Z.

Because of this configuration, after the screws 24*b* are loosened by using, for example, a screwdriver, the second movable unit 16 can be moved along the direction Z relative to the first movable unit 15 by inserting an eccentric screwdriver into a cam receptacle 36 and turning the eccentric screwdriver. After the second movable unit 16 is moved to an appropriate position relative to the first movable unit 15, the screws 24*b* are tightened. Thus, the second movable unit 16 can be appropriately positioned relative to the first movable unit 15. Note that, instead of the configuration that allows an eccentric cam to be inserted from outside, a configuration in which each cam receptacle 36 is provided with an eccentric cam may be adopted.

The frame 14*b* has at each of positions that correspond to threaded shafts of the screws 24*b* such a hole portion (a screw insert hole portion, not depicted) that a gap is formed between a hole edge of the hole portion and the threaded shaft of a screw 24*b* inserted in the hole portion. The screw insert hole portions, concretely, have such a hole size as not to interfere with threaded shafts of the screws 24*b*. That is, the screws 24*b* are not restricted by the frame 14*b*. Therefore, even when the first movable unit 15 is displaced along the direction Y by operating the first adjuster 31 and/or the second adjuster 32, the screws 24*b* can be displaced according to the displacement of the first movable unit 15. This inhibits the screws 24*b* from interfering with movement of the first movable unit 15.

As illustrated in FIG. 2, FIG. 5, FIG. 6, etc., the second movable unit 16 is provided with the guide rail 13 extending in the direction Y and a linear scale 18 that extends along the direction Y and that is attached to a mounting base 20 by an attaching cover 19.

Due to this configuration (in which the guide rail 13 and the linear scale 18 are provided integrally with the second movable unit 16), the position of the linear scale 18 relative to the guide rail 13 can be inhibited from deviating at the time of attaching the carriage 6.

The guide rail 13, as illustrated in FIGS. 5 and 6, is attached to the second movable unit 16 so that a planar portion 13*a* of the guide rail 13 is in contact with a planar portion 16*a* of the second movable unit 16. The planar portion 13*a* is parallel to a attaching surface 17*a* of the carriage 6 of the block 17. Due to this configuration, as the angle of the planar portion 13*a* with respect to the frame 14 as viewed in the direction X (first direction) changes, the posture of the carriage 6 attached to the guide rail 13 also changes.

The angle of the planar portion 13*a* with respect to the frame 14 as viewed in the first direction will be described with reference to FIG. 9.

FIG. 9 illustrates angles θ, θ' and θ" of the planar portion 13*a* (the side surface portion 15*b*, the side surface portion 15*b*', and the side surface portion 15*b*" that are parallel to the planar portion 13*a*) with respect to the frame 14 as viewed in the first direction in the case where the upper surface portion 15*a* is moved to an upstream side and a downstream side in the direction Y relative to the frame 14*a* after the lower surface portion 15*c* has been fixed at an appropriate position relative to the frame 14*c*. As illustrated in FIG. 9, as the upper surface portion 15*a* is moved to the upstream side along the direction Y, the angle of the planar portion 13*a* with respect to the frame 14 as viewed in the first direction decreases from Θ to Θ'. Conversely, as the upper surface portion 15*a* is moved to the downstream side along the direction Y, the angle of the planar portion 13*a* with respect to the frame 14 as viewed in the first direction increases Θ to Θ". Although in the foregoing description, the angle of the planar portion 13*a* with respect to the frame 14 is indicated with reference to the lower frame 14*c* of the frame 14, the reference of angle of the planar portion 13*a* to the frame 14 may also be other than the frame 14*c* (e.g., may be the frame 14*b*).

Note that, as illustrated in FIG. 9, as the upper surface portion 15*a* is moved relative to the frame 14*a* while the lower surface portion 15*c* is fixed to the frame 14*c*, the first movable unit 15 deforms about a boundary portion 21 between the lower surface portion 15*c* and the side surface portion 15*b* and also deforms about a boundary portion 22 between the upper surface portion 15*a* and the side surface portion 15*b*. Concretely, as illustrated in FIG. 8 and the like, the boundary portion 21 and the boundary portion 22 extend along the direction X (the first direction), and are each provided with a cutout portion 29. Because the cutout portions 29 are provided, the first movable unit 15 deform about the boundary portion 21 and the boundary portion 22, so that distortion of the entire first movable unit 15 (distortion of the upper surface portion 15*a*, the side surface portion 15*b*, and the lower surface portion 15*c*) can be inhibited. Furthermore, as the upper surface portion 15*a* is moved, the side surface portion 15*b* pivots about the boundary portion 21. That is, the boundary portion 21 can be said to function as a pivot axis around which the side surface portion 15*b* pivots (i.e., that serves as the center of pivot). In other words, the boundary portion 21 serves as a pivot axis extending in the first direction.

Note that the attaching unit 28 in this exemplary embodiment is configured so that the carriage 6 can be fixed in place of the jig 25 illustrated in FIG. 6 to the block 17 by the screws 24*d*, and can be moved along the first direction by moving the block 17, whose sectional shape corresponds to that of the guide rail 13 as illustrated in FIG. 5, along the direction X (the first direction). Due to this configuration, as the angle of the planar portion 13*a* with respect to the frame 14 as viewed in the first direction is changed, the posture of the guide rail 13 changes corresponding to change in the angle and the posture of the carriage 6 attached to the guide rail 13 also changes accordingly.

In the attaching unit 28 in this exemplary embodiment, as illustrated in FIGS. 5 to 7, the first movable unit 15 is provided with the first adjuster 31 that includes the screws 24*c*, the cam receptacles 26, etc. and that allows adjustment of the position of the guide rail 13 relative to the frame 14 in the direction Y (the second direction) and the second adjuster 32 that includes the screws 24*a*, the cam receptacles 27, etc. and that allows adjustment of the angle of the planar portion 13*a* with respect to the frame 14 as viewed in the first direction.

Note that since, as illustrated in FIGS. 2 and 3, the attaching unit 28 in this exemplary embodiment includes a plurality of first movable units 15 provided along the direction X (the first direction), the position of the guide rail 13 with respect to the frame 14 in the second direction and the angle of the planar portion 13*a* with respect to the frame 14 as viewed in the first direction can be adjusted at a plurality of sites.

That is, the printing apparatus 1 of this exemplary embodiment includes the frame 14, the first movable units 15 displaceably attached to the frame 14, and the guide rail 13 that extends along the first direction, has the planar portion 13*a* formed along the first direction, and is displaced according to displacement of the first movable unit 15. The printing apparatus 1 further includes the carriage 6 which includes the head 4 capable of discharging ink, the carriage is attached to the guide rail 13 so as to be movable along the first direction and whose posture viewed in the first direction changes according to the angle of the planar portion 13*a* with respect to the frame 14 viewed in the first direction.

The first movable unit 15 includes the first adjuster 31 that adjusts the position of the guide rail 13 with respect to the frame 14 in the second direction, which intersects the first direction and in which the guide rail 13 and the frame 14 face each other and the second adjuster 32 that adjusts the angle of the planar portion 13*a* with respect to the frame 14 as viewed in the first direction as the guide rail 13 is pivoted around the pivot axis (the boundary portion 21) that extends in the first direction.

Due to this configuration, the printing apparatus 1 of this exemplary embodiment allows the position of the guide rail 13 relative to the frame 14 in the second direction to be adjusted through the use of the first adjuster 31 and also allows the angle of the planar portion 13*a* with respect to the frame 14 as viewed in the first direction to be adjusted by pivoting the guide rail 13 around the pivot axis extending in the first direction through the use of the second adjuster 32. That is, the printing apparatus 1 of this exemplary embodiment is configured so that the posture of the guide rail 13 can be adjusted in not only the rotation direction but also the second direction, that is, the posture of the guide rail 13 can be adjusted in various directions.

Note that, as illustrated in FIGS. 5 and 6, in the printing apparatus 1 of this exemplary embodiment, the distance L1 between the first adjuster 31 and the guide rail 13 in the third direction (that is along the direction Z and that intersects the first direction and the second direction) is shorter than the distance L2 between the second adjuster 32 and the guide rail 13 in the third direction. That is, the distance between the first adjuster 31 and the guide rail 13 in the third direction is relatively short. In the printing apparatus 1 of this exemplary embodiment, by shortening the distance between the first adjuster 31 and the guide rail 13 in the third direction, the position of the guide rail 13 relative to the frame 14 is inhibited from being changed in the second direction by adjustment through the use of the second adjuster 32 or the like after the position of the guide rail 13 in the second direction has been adjusted by the first adjuster 31.

Note that the "distance between the first adjuster 31 and the guide rail 13 in the third direction" and the "distance between the second adjuster 32 and the guide rail 13 in the third direction" may be, for example, a "distance between a center of the first adjuster 31 and a center of the guide rail 13 in the third direction" and a "distance between a center of the second adjuster 32 and a center of the guide rail 13 in the third direction".

That is, it is desirable that the position of the first adjuster 31 in the third direction be the same as the position of the guide rail 13 in the third direction. This configuration will particularly effectively inhibit the position of the guide rail 13 with respect to the frame 14 from being changed in the second direction by adjustment through the use of the second adjuster 32 after the position of the guide rail 13 has been adjusted in the second direction by the first adjuster 31. The printing apparatus 1 of this exemplary embodiment is configured so that, as illustrated in FIGS. 5 and 6, the position of the first adjuster 31 in the third direction is the same as the position of the guide rail 13 in the third direction.

Note that the expression of "the position of the first adjuster 31 in the third direction is the same as the position of the guide rail 13 in the third direction" means that the position of the center of the first adjuster 31 in the third direction is substantially the same as the position of the center of the guide rail 13 in the third direction and means that a slight positional deviation of the two centers is permissible.

Furthermore, it is preferable that the position of the pivot axis (the boundary portion 21) in the third direction be the same as the position of the guide rail 13 in the third direction. This configuration will effectively inhibit the position of the guide rail 13 in the second direction from deviating when the angle of the planar portion 13*a* with respect to the frame 14 as viewed in the first direction is by the second adjuster 32. In the printing apparatus 1 of this exemplary embodiment, as illustrated in FIGS. 5 and 6, the position of the boundary portion 21 in the third direction is the same as the position of the guide rail 13 in the third direction.

Note that the expression of "the position of the pivot axis (boundary portion 21) in the third direction is the same as the position of the guide rail 13 in the third direction" means that the position of a portion that serves as the pivot axis in the third direction is substantially the same as the position of the center of the guide rail 13 in the third direction and means that slight deviations of the position of the portion that serves as the pivot axis and the position of the center of the guide rail 13 are permissible.

Furthermore, the printing apparatus 1 of this exemplary embodiment, as illustrated in FIGS. 5 and 6, includes the second movable unit 16 that has the planar portion 16*a* to which the guide rail 13 is attached so that the planar portion 13*a* serves as an attaching surface. The second movable unit 16 with the guide rail 13 attached thereto is attached to the first movable unit 15.

The second movable unit 16, as illustrated in FIGS. 5 and 6, includes the third adjuster 33 that is made up of the screws 24*b* and the like and that adjusts the position of the guide rail 13 relative to the first movable unit 15 (i.e., the frame 14) in the third direction that intersects the first direction and the second direction.

Therefore, the printing apparatus 1 of this exemplary embodiment is configured so that the posture of the guide rail 13 can be adjusted not only in the rotation direction and the second direction but also in the third direction, that is, the posture of the guide rail 13 can be adjusted in particularly various directions.

In the printing apparatus 1 of this exemplary embodiment, as illustrated in FIGS. 5 and 6, the frame 14 has four faces (three or more faces) that are the frame 14*a*, the frame 14*b*, the frame 14*c*, and the frame 14*d*. The first adjuster 31 is disposed in the frame 14*c*, the second adjuster 32 is disposed in the frame 14*a*, and the third adjuster 33 is disposed in the frame 14*b*. That is, the first adjuster 31, the second adjuster 32, and the third adjuster 33 are disposed in respectively different faces of the frame 14.

In the printing apparatus 1 of this exemplary embodiment, since the first adjuster 31, the second adjuster 32, and the third adjuster 33 are disposed in respectively different faces of the frame 14, operation regions can be dispersed, so that the adjustment operation can be more easily performed.

Note that the meaning of "the first adjuster 31, the second adjuster 32, and the third adjuster 33 are disposed in respectively different faces of the frame 14" includes not only a configuration in which the first adjuster 31, the second adjuster 32, and the third adjuster 33 are disposed directly in respectively different faces of the frame 14 but also a configuration in which at least one of the first adjuster 31, the second adjuster 32, and the third adjuster 33 is disposed indirectly on one of different faces of the frame 14 via another member, as is the case with the third adjuster 33 in this exemplary embodiment.

In other words, in the printing apparatus 1 of this exemplary embodiment, the frame 14 has the frame 14*c* as a first face that faces one of two sides in the third direction, the frame 14*a* as a second face that faces the other side in the third direction, and the frame 14*b* as a third face that faces one of two sides in the second direction, and the first adjuster 31, the second adjuster 32 is disposed, and the third adjuster 33 are disposed in the first face, the second face, and the third face, respectively. In this manner, the adjusters are suitably dispersed to different faces of the frame 14.

Note that in the printing apparatus 1 of this exemplary embodiment, when the guide rail 13 is to be adjusted, the jig 25 is attached in place of the carriage 6 as illustrated in FIGS. 5 and 6. This is because the operability in the adjustment of the guide rail 13 is improved by performing the adjustment with respect to a planar portion and also by performing the adjustment with the jig 25, which has a higher degree of freedom in shape, attached in place of the carriage 6. The use of the jig 25 allows the available operation space to be increased, the planarity of the place for adjustment to be increased, a high-precision shape to be adopted (e.g., a length in the third direction to be increased, etc.), etc. However, the adjustment of the guide rail 13 may also be performed with the carriage 6 attached to the guide rail 13. Furthermore, the adjustment of the guide rail 13 may also be performed by using the block 17 and the planar portion 16*a*. It is preferable that when the adjustment of the guide rail 13 is to be performed with the jig 25 attached in place of the carriage 6, the jig 25 be the same as the carriage 6 in terms of weight, the position of the center of gravity, etc. In order to make the weight, the position of the center of gravity, etc. of the jig 25 the same as those of the carriage 6, it is possible to produce such a jig beforehand and also to adopt a configuration in which a weight or balance can be attached to the jig.

In the printing apparatus 1 of this exemplary embodiment, the adjustment of the guide rail 13 is performed by adjusting the position of the guide rail 13 in the second direction with a dial gauge placed in contact with a position PY indicated in FIG. 6, adjusting the position of the guide rail 13 in the second direction with the dial gauge placed in contact with a position PΘ indicated in FIG. 6, and adjusting the position of the guide rail 13 in the third direction with the dial gauge placed in contact with a position PZ indicated in FIG. 6. That is, in the printing apparatus 1 of this exemplary embodiment, the adjustment of the angle of the planar portion 13*a* with respect to the frame 14 as viewed in the first direction through the use of the second adjuster 32 is carried out by the positional adjustment in the second direction at the position PY and the positional adjustment in the second direction at the position PΘ.

A rail unit adjustment method carried out in the printing apparatus 1 of this exemplary embodiment will be described below with reference to a flowchart.

Figure 10:
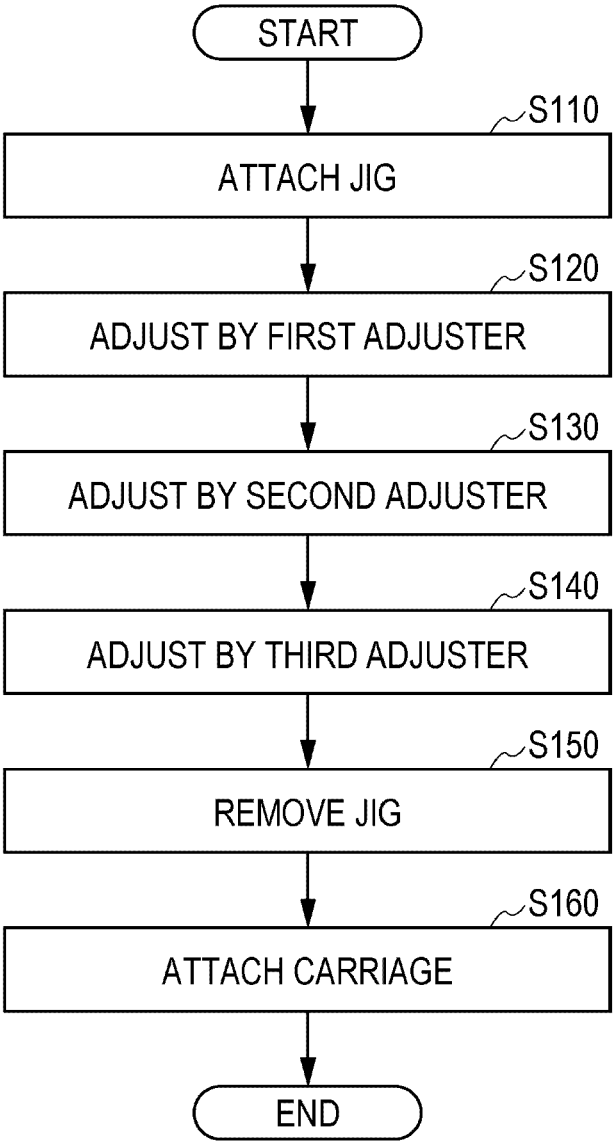
FIG. 10 is a flowchart of a rail unit adjustment method according to the exemplary embodiment of the invention.

FIG. 10 is a flowchart of a rail unit adjustment method (an adjustment method for the guide rail 13) carried out in the printing apparatus 1 of this exemplary embodiment.

First, in step S110, the jig 25 is attached to the block 17 by using the screws 24*d*.

Next, in step S120, a dial gauge is placed in contact with the position PY and the position of the guide rail 13 with respect to the frame 14 in the second direction is adjusted by the first adjuster 31.

Next, in step S130, the dial gauge is placed in contact with the position PΘ and the angle of the planar portion 13*a* with respect to the frame 14 as viewed in the first direction is adjusted by adjusting the position of the guide rail 13 with respect to the frame 14 in the second direction through the use of the second adjuster 32.

Next, in step S140, the dial gauge is placed in contact with the position PZ and the position of the guide rail 13 with respect to the frame 14 in the third direction is adjusted by the third adjuster 33.

Next, in step S150, the jig 25 is removed from the block 17.

Finally, in step S160, the carriage 6 is attached to the block 17 by using the screws 24*d*. Then, the adjustment method for the rail unit in this exemplary embodiment is ended.

As described above, the rail unit adjustment method in this exemplary embodiment is performed on the printing apparatus 1. That is, this rail unit adjustment method is one for a rail unit in the printing apparatus 1 that includes the frame 14, the first movable units 15 displaceably attached to the frame 14, the guide rail 13 that extends in the first direction, includes the planar portion 13*a* formed along the first direction and that is displaceable according to displacement of the first movable units 15, and the carriage 6 which includes the head 4 capable of discharging ink and is attached to the guide rail 13 so as to be movable in the first direction and whose posture as viewed in the first direction is changeable according to the angle of the planar portion 13*a* with respect to the frame 14 as viewed in the first direction.

In the adjustment method, the position of the guide rail 13 with respect to the frame 14 in the second direction which intersects the first direction and in which the guide rail 13 and the frame 14 face each other is adjusted by the first movable units 15 (step S120), and the angle of the planar portion 13*a* with respect to the frame 14 as viewed in the first direction is adjusted by pivoting the guide rail 13 around the pivot axis extending in the first direction through the use of the first movable units 15 (step S130).

According to the adjustment method for the rail unit in this exemplary embodiment, the position of the guide rail 13 with respect to the frame 14 in the second direction can be adjusted by the first movable units 15, and the angle of the planar portion 13*a* with respect to the frame 14 as viewed in the first direction can be adjusted by pivoting the guide rail 13 around the pivot axis extending in the first direction. That is, the posture of the guide rail 13 can be adjusted in not only the rotation direction but also the second direction. Thus, the posture of the guide rail 13 can be adjusted in various directions.

It should be apparent that the invention is not limited by the foregoing exemplary embodiment but various modifications and changes can be made within the scope of the invention described in the appended claims and are encompassed in the scope of the invention.

This application claims priority under 35 U.S.C. § 119 to Japanese Patent Application No. 2017-026157, filed Feb. 15, 2017. The entire disclosure of Japanese Patent Application No. 2017-026157 is hereby incorporated herein by reference.

What is claimed is:

1. A liquid discharge apparatus comprising:

a fixture portion;

a first movable unit displaceably attached to the fixture portion;

a rail unit that extends in a first direction, includes a planar portion formed along the first direction, and is displaceable according to displacement of the first movable unit;

a second movable unit to which the rail unit is attached so that the planar portion serves as an attaching surface and which is attached to the first movable unit together with the rail unit attached; and a carriage which includes a head capable of discharging a liquid, the carriage is attached to the rail unit so as to be movable in the first direction and whose posture as viewed in the first direction is changeable according to angle of the planar portion with respect to the fixture portion viewed in the first direction, wherein the first movable unit includes a first adjuster that adjusts position of the rail unit with respect to the fixture portion in a second direction which intersects the first direction and in which the rail unit and the fixture portion face each other, and a second adjuster that adjusts the angle of the planar portion with respect to the fixture portion as viewed in the first direction by pivoting the rail unit around a pivot axis that extends in the first direction, and wherein the second movable unit includes a third adjuster that adjusts position of the rail unit with respect to the first movable unit in a third direction that intersects the first direction and the second direction.

2. The liquid discharge apparatus according to claim 1, wherein a distance between the first adjuster and the rail unit in a third direction that intersects the first direction and the second direction is shorter than a distance between the second adjuster and the rail unit in the third direction.

3. The liquid discharge apparatus according to claim 2, wherein a position of the first adjuster in the third direction is the same as a position of the rail unit in the third direction.

4. The liquid discharge apparatus according to claim 1, wherein a position of the pivot axis in a third direction that intersects the first direction and the second direction is the same as a position of the rail unit in the third direction.

5. The liquid discharge apparatus according to claim 1, wherein the fixture portion has three or more faces, and wherein the first adjuster, the second adjuster, and the third adjuster are disposed in respectively different faces of the three of more faces of the fixture portion.

6. The liquid discharge apparatus according to claim 5, wherein the fixture portion has a first face that faces one of two sides in the third direction, a second face that faces another one of the two sides in the third direction, and a third face that faces one of two sides in the second direction, and wherein the first adjuster is disposed in the first face, and wherein the second adjuster is disposed in the second face, and wherein the third adjuster is disposed in the third face.

7. A rail unit adjustment method for a liquid discharge apparatus that includes a fixture portion, a first movable unit displaceably attached to the fixture portion, a rail unit that extends in a first direction, includes a planar portion formed along the first direction, and is displaceable according to displacement of the first movable unit, a second movable unit to which the rail unit is attached so that the planar portion serves as an attaching surface and which is attached to the first movable unit together with the rail unit attached, and a carriage which includes a head capable of discharging a liquid, the carriage is attached to the rail unit so as to be movable in the first direction and whose posture as viewed in the first direction is changeable according to angle of the planar portion with respect to the fixture portion viewed in the first direction, the rail unit adjustment method comprising:

adjusting position of the rail unit with respect to the fixture portion in a second direction which intersects the first direction and in which the rail unit and the fixture portion face each other by using the first movable unit;

adjusting angle of the planar portion with respect to the fixture portion as viewed in the first direction by pivoting the rail unit around a pivot axis extending in the first direction through use of the first movable unit; and adjusting position of the rail unit with respect to the first movable unit in a third direction that intersects the first direction and the second direction by using the second movable unit.

* * * * *